US006655766B2

(12) United States Patent
Hodges

(10) Patent No.: US 6,655,766 B2
(45) Date of Patent: Dec. 2, 2003

(54) REFRIGERATION CABINET

(75) Inventor: Andrew Hodges, Downham Market (GB)

(73) Assignee: Foster Refrigerator (UK) Limited (GB)

( * ) Notice: Subject to any disclaimer, the term of this patent is extended or adjusted under 35 U.S.C. 154(b) by 30 days.

(21) Appl. No.: 09/923,275

(22) Filed: Aug. 6, 2001

(65) Prior Publication Data

US 2002/0021062 A1 Feb. 21, 2002

(30) Foreign Application Priority Data

Aug. 9, 2000 (GB) ..... 0019596

(51) Int. Cl.[7] ..... A47B 96/04
(52) U.S. Cl. ..... 312/406.2; 49/478.1
(58) Field of Search ..... 312/401, 409, 312/405, 406, 406.1, 406.2, 407, 116, 296; 49/489.1, 478.1, 501; 62/440, 272

(56) References Cited

U.S. PATENT DOCUMENTS

| | | | | | |
|---|---|---|---|---|---|
| 2,958,210 | A | * | 11/1960 | Rill, Jr. | 62/440 X |
| 3,353,301 | A | | 11/1967 | Heilweil et al. | |
| 4,714,304 | A | * | 12/1987 | Sisk et al. | 312/406.2 |
| 4,732,432 | A | * | 3/1988 | Keil et al. | 312/406.2 |
| 4,776,903 | A | * | 10/1988 | Nordskog | 312/409 X |
| 5,388,904 | A | * | 2/1995 | Kuwahara et al. | 312/406.2 |
| 5,720,536 | A | * | 2/1998 | Jenkins et al. | 312/406.2 |
| 5,876,104 | A | * | 3/1999 | Kunkel et al. | 312/406.1 |
| 6,056,383 | A | * | 5/2000 | Banicevic et al. | 312/406 |

FOREIGN PATENT DOCUMENTS

| | | | | |
|---|---|---|---|---|
| DE | 1105893 | * | 5/1961 | 312/406.2 |
| DE | 9211008.8 | | 2/1993 | |
| EP | 0161730 | | 11/1985 | |
| EP | 0213310 | | 3/1987 | |
| EP | 0388550 | | 9/1990 | |
| EP | 0583984 | | 2/1994 | |

* cited by examiner

*Primary Examiner*—James O. Hansen
(74) *Attorney, Agent, or Firm*—Thompson Hine LLP

(57) ABSTRACT

Refrigerator cabinet having an inner liner and outer shell. The liner and shell are connected by a hollow member having low thermal conductivity around the opening of the cabinet. The hollow member includes a strip of magnetic material against which a closure, such as a door, of the cabinet abuts. The hollow member includes a removable cover permitting access to the interior of the hollow member.

18 Claims, 4 Drawing Sheets

REFRIGERATION CABINET

CROSS REFERENCE TO RELATED APPLICATIONS

This Application claims priority from British Patent Application No. 0019596.6 filed on Aug. 9, 2000.

FIELD OF THE INVENTION

The present invention relates to refrigeration cabinets, and in particular to a thermal break for use in such refrigeration cabinets, and to an improved method of assembling refrigeration cabinets including such a thermal break.

BACKGROUND OF THE INVENTION

Many refrigeration cabinets, which term includes refrigerators and freezers, especially for industrial and commercial use, cooled display cabinets, morgue cabinets and the like are usually formed of metal, more typically stainless steel, for hygienic purposes, especially ease of cleaning. Typically, such cabinets include an inner stainless steel liner and an outer stainless steel carcass or shell, with the void between the liner and shell being filled with an insulating foam material to provide the desired thermal insulation. As the inside surface of the refrigeration cabinet is at a desired low temperature, and the outside surface will be at an ambient temperature, which in the case of a commercial kitchen will typically be relatively high, for example up to 40° C., there will be thermal tracking between the inside and outside metallic surfaces of the cabinet. This reduces the efficiency of the refrigeration cabinet, since additional cooling will be required to overcome the losses due to thermal tracking. Further, the thermal tracking may lead to the formation of condensation around the door seal. This, in turn, may result in a pool of condensate on the floor. This is undesirable.

A further problem is that the majority of commercial door seals are magnetic. In particular, the door includes a rubber or plastic gasket within that is provided a magnetic strip. This is attracted to the metallic frame of the refrigeration cabinet to keep the door closed. In general, the inner and outer surfaces of the refrigeration cabinets are formed from stainless steel that has a high corrosion resistance, and is therefore a good material for forming the shell and exterior of the cabinet, as this is easy to clean and has a long life. However, such grades of stainless steel may not be magnetic. Therefore, a section of stainless steel having a higher iron content that is magnetic is used to form a door surround that will attract the magnetic strip in the door seal. However, this different grade strip is more susceptible to corrosion.

In an attempt to overcome the problems associated with thermal tracking, it is known to form a thermal break between the inside stainless steel lining of the cabinet and the outer shell using a rubber or plastic strip or break that is positioned between the liner and outer shell. However, this has not proved entirely successful as part of the outer shell, on the outside of the thermal break, will be within the cold interior of the refrigerator cabinet, and therefore thermal tracking and the associated problems will still occur. It has also been proposed to form a thermal break using a hollow plastic member. However, with such an arrangement, it is difficult to form a seal with the door gasket, and the strip has a poor appearance.

Due in part to this thermal tracking, the metallic strip that attracts the magnetic strip in the door gasket will become very cold, and, especially in freezers and other very low temperature cabinets, there is the risk that the strip will become sufficiently cold that the gasket will freeze onto the strip, therefore preventing the door from being opened without damaging the gasket. To overcome this problem, it is known to provide a heater wire behind the region of the door frame on which the door gasket seals. This heater must be positioned before the void between the inner liner and the outer shell of the cabinet is filled with foam. In some cases, especially when the void is filled with foam, damage to the heater wire occurs. In this case, the door frame cannot be heated. In an attempt to overcome this problem, it is known to mount two heaters, side-by-side, behind the door frame. In this way, in the event that one of the heaters fails, either during manufacture or in use, the other heater may be used. Clearly, the requirement to provide two heaters is undesirable due to the additional manufacturing cost. Even where two heaters are provided, in some cases, especially during the use of the refrigeration cabinet, both heaters may fail. In this case, it is not possible to replace the heaters due to the insulation between the inner liner and the outer shell of the cabinet which prevents access, and therefore it is necessary to add an additional frame on the front of the cabinet that includes a new heater element. This is undesirable as it does not have an attractive appearance.

A problem with refrigeration cabinets including a known thermal break as described above is their assembly. In particular, it is difficult to correctly position the liner within the shell, and in general requires the liner to be pulled into the cabinet from the rear while the cabinet is horizontal. This may mean that a person assembling the cabinet has to crawl under the upturned cabinet, and then pull on the liner to get this into the required position. This is likely to cause injury to the assembler, and this in turn can be very expensive to the manufacturer.

A further issue in the manufacture of refrigeration cabinets is the sub-division of the cabinet. In some cases, a cabinet will require a single door for the entire opening of the cabinet. In other cases, the cabinet will require sub-division, using cross-members, to allow multiple doors or drawers giving access to different internal parts of the cabinet. The problems of thermal tracking and the need for and provision of heating elements that apply to the outer frame of the cabinet apply also to each of these partitioning members. Further, it is necessary to determine, when the cabinet is initially being made, which partitions will be required since the cross-members and heaters must be formed and foam filled with the remainder of the cabinet.

BRIEF SUMMARY OF THE INVENTION

According to a first aspect of the present invention, a refrigerator cabinet including an inner liner defining an interior of the cabinet and an outer shell is provided with a hollow member having low thermal conductivity connected between the inner liner and the outer shell around an opening of the cabinet, the hollow member including a strip of magnetic material against which a closure of the cabinet abuts, and a removable cover permitting access to the interior of the hollow member.

With the cabinet according to the present invention, an effective thermal break is provided between the inner liner and the outer shell of the cabinet. In particular, the hollow member between the inner liner and outer shell has low thermal conductivity, and therefore there is little thermal conduction or tracking across the member. Further, as the member includes the surface against which the closure of the cabinet, which may be a door or the front face of a drawer for example, no part of the outer shell is inboard of the thermal break on the cooled interior of the cabinet. Therefore, there is no bridging of the thermal break, as is the case in the prior art.

A further advantage of the arrangement of the present invention is that a heater element may be provided within the thermal break itself, namely within the hollow member. Preferably, the heater element may be provided behind the strip of magnetic material so this can directly heat the surface against which the closure abuts, and thereby prevent the freezing of the closure on the surface. The ability to provide a heater element within the hollow member of the thermal break, in particular by removal of the cover to gain access to the hollow interior of the thermal break and to add or remove a heater element at this time has considerable advantages. In particular, it becomes possible to manufacture all basic cabinets without a heater element. Then, after assembly of the basic unit, a decision can be made as to whether a heater element will be required, and only if such an element is required will one be installed. This means that the same basic unit can be formed and stocked, and when a customer requires a unit with a heater, a heater can be installed. If a customer requires a unit without a heater, the same basic unit can be used. This means that it is not necessary to stock different units that differ only in the provision of a heating element. This in turn results in a quicker turnover. A further advantage is that there is less risk of damage to a heater when this is installed than is the case where a heater is installed within the metal shell of a cabinet before being foam filled. Therefore, there is less failure of the heater element during manufacture. This in turn means that there is no requirement to provide redundant heaters in case one heater fails during manufacture. This gives a further cost advantage. Further, there is no requirement to provide spare or redundant heaters in case one fails during use, since, according to the present invention, if a heater fails in use it will be possible to access this and repair or replace this. This also leads to a cost saving. Furthermore, in the event that the heater does fail, there is no need to provide a new frame to include a new heater, as is the case in the prior art. This represents a further cost saving, and means that the attractive appearance of the cabinet can be maintained, without requiring a further, unsightly, frame being added.

It is preferred that the low thermal conductivity hollow member is formed of a plastic material. The hollow member is preferably moulded or extruded. If necessary, the member may be cut to the required size. The strip of magnetic material, which advantageously includes a stainless steel material, and which may be brushed to give an attractive appearance, is preferably bonded to the hollow plastic material. The bonding of the strip is advantageously carried out during molding or extrusion of the member. Bonding the strip to the hollow member helps ensure that the strip does not separate or peel away from the hollow member over time.

The hollow member may include a flange that abuts against the liner or shell. In this case, it is preferred that an adhesive strip is provided to attach the flange to the liner or shell. This form of attachment is advantageous both as it provides a simple yet reliable connection, but also as it provides a good seal between the member and the liner or shell. This is important as, when the void between the shell and the liner is foam filled to give the desired insulation, it is necessary to provide a seal between the liner and hollow member and between the shell and hollow member to prevent the leakage of the foam. Therefore, the use of an adhesive strip acts both as a connection and to provide the required seal.

Alternatively, or additionally, the hollow member may be provided with a clip or cleat that allows the liner and/or shell to be attached to the hollow member by an interference fit. This also provides a good, simple connection between the liner or shell and the hollow member, which also gives a good seal to prevent leakage.

As the surfaces of the liner and shell to which the hollow member is attached will generally be perpendicular to each other, it is preferred that the hollow member includes one clip or cleat for an interference fit with one of the liner and shell and includes an adhesive strip for connection to the other of the liner and shell. In this way, the hollow member may merely be pressed into the corner between the liner and the shell to connect to both.

It is preferred that the hollow member is formed as a frame for the opening of the cabinet before being installed in the cabinet as a single piece. This has the advantage that the hollow member can be more easily and neatly formed that would be the case if separate pieces were mounted individually around the opening of the cabinet. This will be especially apparent at the corners of the opening.

To form a frame, it is preferred that the ends of the hollow member at the corners are suitably mitred to give a structurally strong and clean join between the parts of the frame extending in different directions. For further rigidity, it is provided that a corner piece is provided to connect parts of the hollow member at the corners of the frame. The corner piece preferably comprises a connector having two legs spaced by an angle corresponding generally to the angle between the two parts of the hollow member. Generally, the desired angle between the two parts of the frame at the corners will be 90°, and therefore the angle between the two legs of the connector will also be about 90°. To ensure the required rigidity, it is preferred that the corner piece is formed as a unitary piece.

It is advantageous for the corner piece is formed form the same material as the hollow member. This allows for easier and more reliable connection between the corner piece and the hollow member. In particular, it is preferred that the cornet piece is formed of a plastic material, and in this case this may be ultrasonically welded to the hollow member. Advantageously, the corner piece and hollow member are formed with corresponding projections and recesses to ensure their accurate relative positioning. This may also assist the connection between the components.

It is preferred that the ends of the cover strips covering the hollow member around the opening of the cabinet are shaped or mitred to abut closely to each other at the corners of the opening. Preferably, the rear part of the strip that includes the means for connection to the hollow member is spaced back from the end of the cover strip. Preferably, the connection part is also angled away from the end of the cover strip. In this way, greater clearance around the corners may be provided. This is of particular benefit for the passage of a heater through the hollow member.

Advantageously, cross-members for sub-division of the opening of the refrigeration cabinet may be removably attached to the hollow member. In this way, it is possible to form and stock cabinets having a single opening. When a customer requires a cabinet sub-divided in a particular way, it is then possible to add the required cross-members to partition the cabinet. This is of considerable advantage over the prior art that provides no way for sub-dividing a cabinet after the initial carcass has been formed and the void between the liner and outer shell foam filled. In particular, it is possible to greatly reduce the time between the receipt of an order and delivery, since it is possible to stock basic units and then to merely add the required partitions in response to a customer order, rather than making a complete unit from scratch in accordance with the customer requirement. Further, there is no need to stock a large number of pre-formed cabinets partitioned in different ways to try and have, in stock, any configuration required by a customer. Therefore, this aspect of the present invention allows a wider range of configurations to be supplied more quickly, and with less stock than has previously been the case.

It is preferred that the partitions are formed by two hollow members are used for the thermal break of the refrigeration unit, each of which are attached to a liner that extends into the interior of the cabinet to sub-divide the interior of the cabinet, and a face panel provided between the two hollow members. With this arrangement, the hollow members act as an effective thermal break to prevent thermal tracking between the partitions in the cabinet.

The closures for the cabinet, which may include one or more doors and/or one or more drawers, preferably include a gasket on the back face of the door or face of the drawer, the gasket including a strip of magnetic material and being arranged to abut against the magnetic strip of the hollow member when the closure is closed. In this way, the closure is kept in a closed condition by the magnetic attraction between the strips in the gasket and on the hollow member.

According to a second aspect of the present invention, a method of assembling a refrigeration unit comprises the steps of forming a frame defining an opening of the cabinet from a hollow member having low thermal conductivity, providing an inner liner for defining the interior of the cabinet and providing an outer shell defining the carcass of the cabinet, joining the inner liner to the hollow member and joining the hollow member to the outer shell, and filling the void between the inner liner and the outer shell with a material having low thermal conductivity.

In example of the present invention will now be described in accordance with the accompanying drawings, in which:

DETAILED DESCRIPTION OF THE PREFERRED EMBODIMENT

Figure 1:
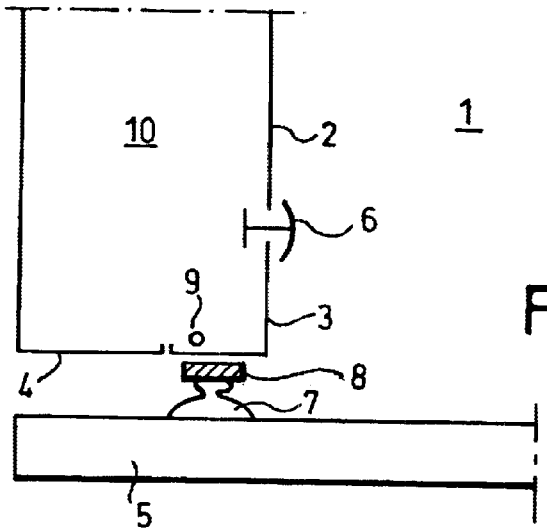
FIG.1. (PRIOR ART)
FIG. 1 shows a cross-section through the corner section of a refrigeration cabinet.

FIG. 1 shows a horizontal cross-section through the frame section of a known refrigeration cabinet including a known thermal break. A stainless steel liner 2 defines the interior 1 of the cabinet. The outer shell 4 defines the cabinet itself. Both the inner liner 2 and the outer shell 4 are formed of high grade, corrosion resistant, stainless steel, for example 304-grade stainless steel. A corner piece 3 surrounding the door frame is formed of magnetic stainless steel, for example 430 grade stainless steel. A rubber or plastic thermal break 6 is provided between the liner 2 and the corner piece 3. A heater element 9 is provided behind the corner piece 3 along the entire length of the door surround. If required, cross-members to partition the cabinet are also formed, these being of a similar construction to the main frame with an associated thermal break and corner piece, and a heater running behind the corner piece 3. Once the outer shell 4, corner piece 3, liner 2, thermal break 6 and heater 9 are assembled, the void between the liner 2 and outer shell 4 is filled with insulating foam 10.

A gasket 7 is mounted around the periphery of the door or drawer 5. If a partition is included, addition al doors or drawers 5, each with a gasket 7, will be provided. The gasket 7 includes a magnetic strip 8. When the door or drawer 5 is closed, the magnetic strip 8 is attracted to the magnetic material of the corner piece 3, thereby keeping the door or drawer 5 closed.

The thermal break 6 is designed to minimise thermal tracking between the cold liner 2 and the warmer outer shell 4. In particular, due to the poor thermal conductivity of the thermal break 6, it is difficult for thermal energy to pass across this. However, it will be appreciated that a significant portion of the corner piece 3 is within the interior 1 of the cabinet, and therefore this portion will be cooled. Therefore , thermal tracking will still occur between the interior 1 of the cabinet and the outer shell 4 via the corner piece 3. This will result in condensation forming on the corner piece 3 which is undesirable, both as this may result in the formation of a pool of water on the floor below the cabinet, and as the condensation may cause corrosion of the corner piece 3. Another problem is that condensation forming on the corner piece 3 may freeze, due to the corner piece being cooled to the temperature of the interior 1 of the cabinet. This freezing will result in damage to the door gasket 7 if any attempt is made to open the door or drawer 5 at this time. Therefore, a heater 9 is provided behind the corner piece 3 to maintain the corner piece 3 at a temperature that prevents freezing, and therefore prevents this damage to the door gasket 7. As explained above, in the event that the heater element 9 fails, it is not possible to replace this. In some applications, in particular those in which the cabinet is not cooled to below freezing point, no heater will be required.

Figure 2:
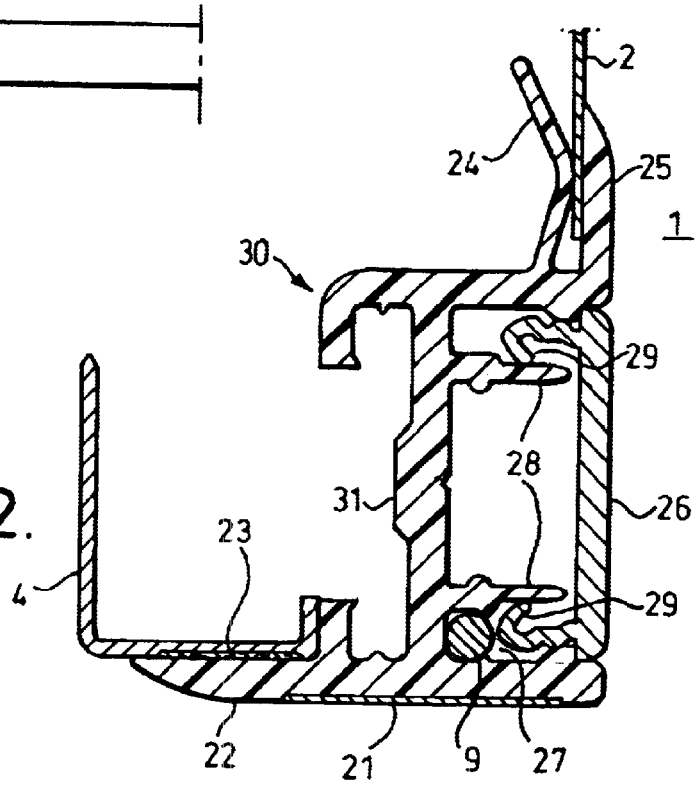
FIG. 2 shows an enlarged cross-section through the corner section of a refrigeration cabinet according to the present invention.

FIG. 2 shows. an example of a thermal break according to the present invention. In this example, the corner piece 3 of the prior art is replaced by a plastic molding or extrusion 30. This is attached to the front face of the outer shell 4 by an adhesive strip 23 provided on the back surface of a front flange 22. The plastic molding or extrusion 30 is attached to the liner 2 by an interference fit between a cleat 24 and a flange 25.

To provide a surface for attracting the magnetic strip in the door gasket, a thin stainless steel strip 21 is formed on the front of the plastic molding 30. The stainless steel strip 21 may be thermally bonded to the plastic molding 30 during extrusion of the molding 30.

A heater element 9 is provided, where required, within the hollow molding 30 in a position behind the stainless steel strip 21. This allows the stainless steel strip 30 to be heated, thereby preventing the door gasket freezing onto the strip 21 when the door is closed. A removable cover 26 is provided to close the hollow plastic molding 30. This gives the corner piece an improved appearance, and also protects the heater 9 within the molding 30. However, in the event of a failure of the heating element 9 in use, the cover 26 may be removed allowing access to and replacement of the heater element 9. This avoids the need to provide additional heating elements 9 behind the stainless steel strip 21 when the cabinet is formed, thereby reducing the manufacturing cost, and also prevents the need to add an additional frame to enclose a new heating element if the heating element breaks during use. Further, it is possible to manufacture all cabinets without a heating element, and then to incorporate a heating element when this is required. This is particularly useful since, in applications where the interior of the cabinet is not cooled to a temperature below freezing, for example where mere refrigeration is required, there is no need to include a heater element.

In the prior systems, at the point of assembling the cabinet, a decision had to be made as to whether the cabinet was for a refrigerator, in which case no heater was required, or for a freezer, in which case a heating element was required. After a decision had been made that a particular cabinet was to be a refrigerator, and therefore no heater was included, it would not be possible to add a heater and use the cabinet as a freezer. Therefore, where both refrigerators and freezers are manufactured, there is a need for additional stock to be carried both with and without heaters. The only way to avoid this is to include heater elements in all cabinets, and then, when a cabinet is to be used as a refrigerator rather than a freezer, merely not use the installed heaters. This is clearly not cost effective due to the inclusion of redundant components. With the arrangement of the present invention, all cabinets may be formed, and then heaters added into the plastic molding or extrusion 30 for those cabinets that are to be used as freezers as required. This gives a significant cost saving, as there is no need to install redundant heaters, yet only one type of cabinet need be stocked. A further advantage of the present invention is that the main cause of damage to heating elements in the prior systems occurs when the void between the liner and shell is foam filled, applying pressure to the heaters. With the present invention, the heater is installed after foaming of the cabinet, and therefore this cause of damage to the heater is avoided.

In the example shown in FIG. 2, the hollow molding 30 includes two legs 28 that define a gap 27 between the legs 28 and the side of the molding 30. One of these gaps receives the heating element 9, and both receive legs 29 of the cover strip 26 to hold this in position.

Figure 3:
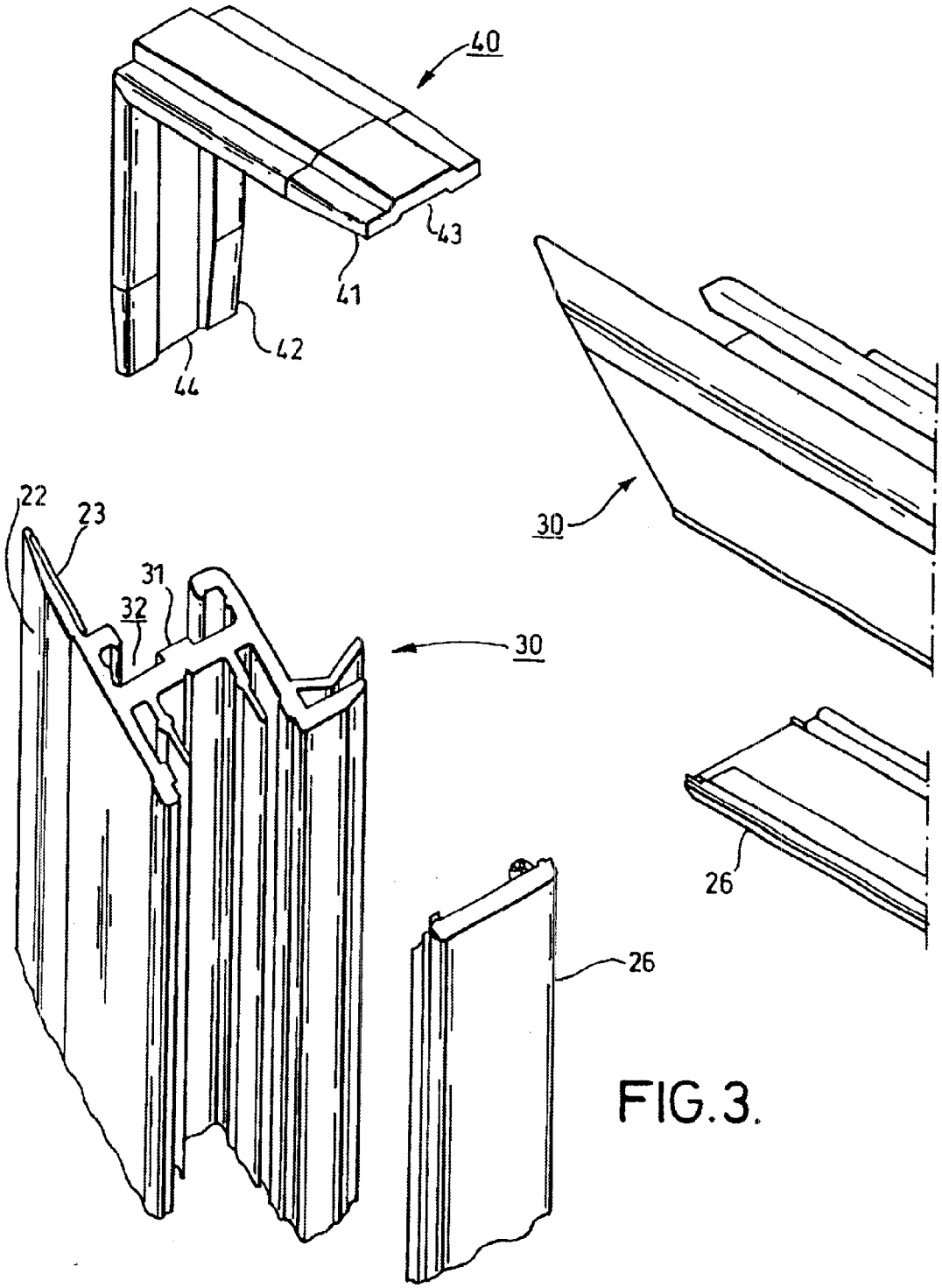
FIG. 3 shows an exploded view of a corner section of a frame.

A further feature of the present invention is the way in which the plastic moldings 30 are connected to form a frame around the door of the cabinet. this connection is best seen in FIG. 3, which shows an exploded view of two plastic moldings 30 arranged to be connected perpendicular to each other, the associated cover strips 26, and a corner piece 40. The ends of the moldings 30 are suitably mitred to form a clean corner joint. The corner piece 40 comprises a single moulded component having two perpendicular legs 41, 42. The legs 41, 42 have a width allowing the corner piece 40 to fit within the recess 32 on the back of the plastic molding. In particular, the sides of the legs 41, 42 abut the side walls of the recess 32, thereby preventing the corner piece from twisting with respect to the moldings 30. Further, the legs 41, 42 each include a recess 43, 44 which receives a projection 32 on the back of the molding 30. This again assists in preventing twisting between the corner piece 40 and the moldings 30. Further, this contact between the base of the recess 43, 44 and the projection 32 of the molding 30 allows the corner piece 40 to be ultrasonically welded to the molding 30 giving a reliable join.

Figure 4:
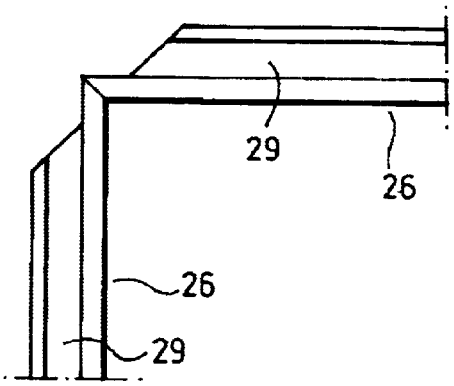
FIG. 4 shows the mitring of cover strips for a corner section.

As can be seen in FIGS. 3 and 4, the ends of the cover strips 26 are suitably mitred so that the cover strips join neatly. Also, the legs 29 of the cover strips 26 are cut back at an angle away from the end of the strip 26. As can be seen best in FIG. 4, in the area where the heater element 9 is to pass around the corner in the assembled frame, this gives a larger clearance, allowing the heater element 9 to pass smoothly around the corner, rather than being bent sharply, In accordance with the present invention, the preferred method of assembling a refrigeration cabinet is to form separately the outer shell, the inner liner and the frame is formed from the plastic moldings 30. The cabinet may then be assembled by clipping the frame onto the liner, and then pushing the liner and frame into position within the outer shell. As the frame is pressed against the outer shell, the adhesive strip 23 on the rear of the flange 22 comes into contact with the front of the shell to adhere the frame to the shell. In this way, the assembly of the liner into the shell is much easier that in the conventional assembly system as this may merely be pushed into the outer shell with the shell in any orientation. Therefore, the problems of the prior art where an assembler may need to pull the liner into the shell is avoided, and with it the risk of injury to the assembler. The use of an adhesive strip to adhere the frame to the outer shell has two main advantages over other attachment systems. Firstly, the adhesion provides a simple way to join the components. Secondly, and more importantly, the adhesive strip forms a seal between the frame and the outer shell. This is important as the final step in the assembly of the basic cabinet is to foam fill the void between the liner and the outer shell. The seal resulting from the adhesive strip ensures that there is no significant leakage of foam from this area, without the need for additional sealing.

Figure 5:
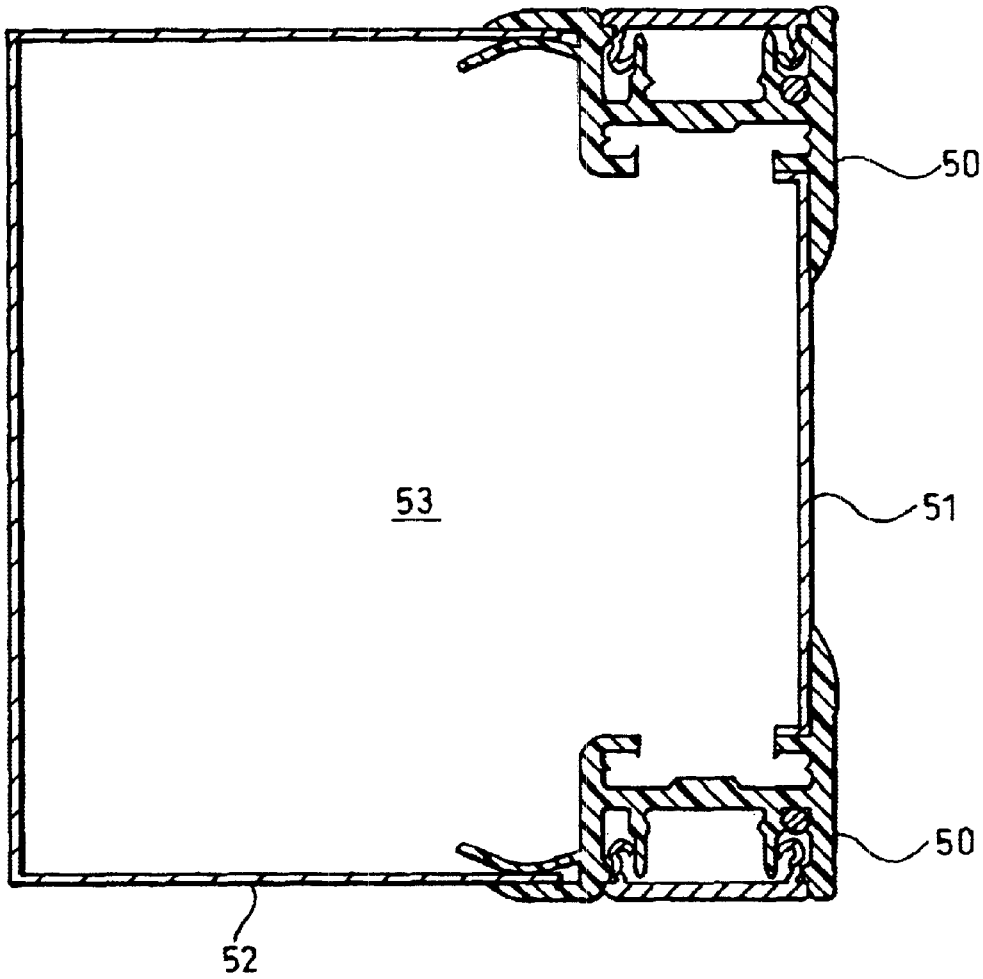
FIG. 5 shows a cross-section through a cross-member.
Figure 6:
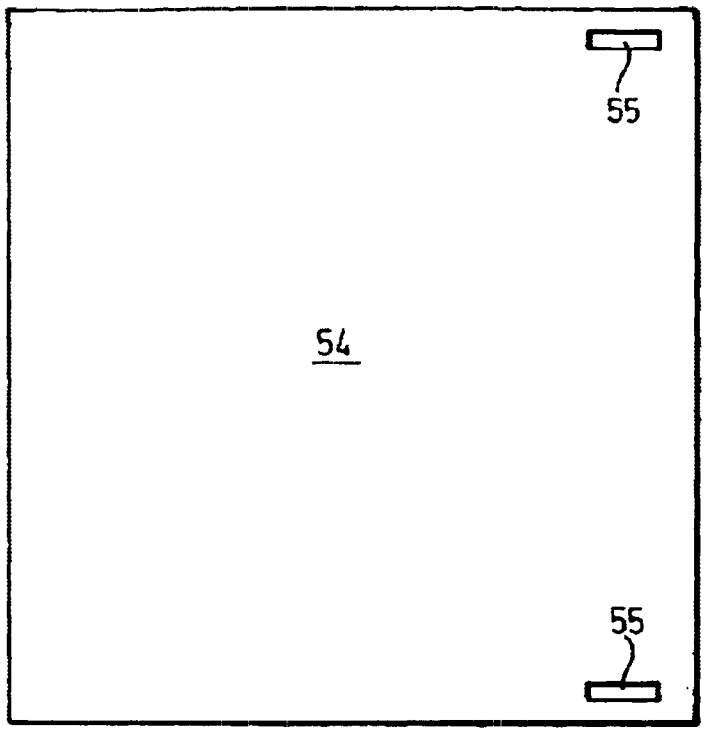
FIG. 6 shows an end cap for a cross-member.
Figure 7:
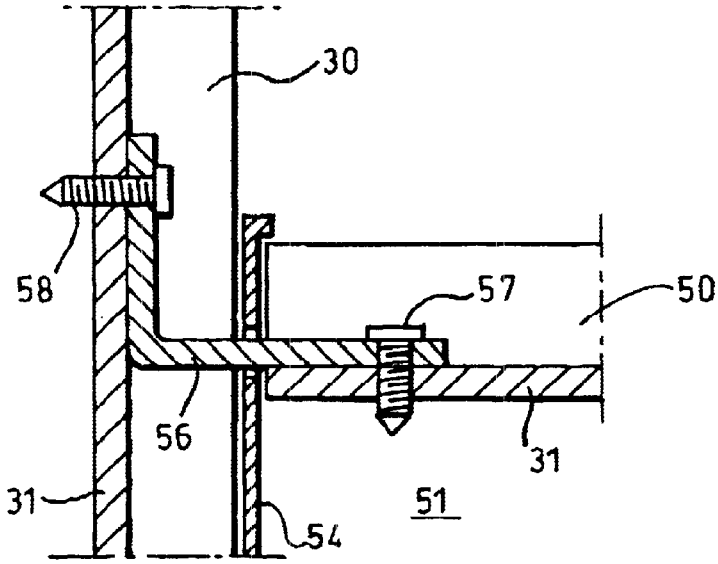
FIG. 7 shows a cross-section through a joint between a mullion and frame in a refrigeration cabinet.

A further feature of the present invention relates to the subdivision of the cabinet, for example to allow multiple doors or different combinations of doors and drawers and different internal sections to be defined using cross-members or mullions. A mullion may be formed separately as shown in FIG. 5. In particular, the mullion is formed from a stainless steel section 52, a stainless steel front plate 51 and two plastic moldings 50, generally similar to those that form the frame of the cabinet as described above. End caps 54 are provided on either end of the mullion to seal this. The interior of the mullion is then filled with foam to give the required rigidity to the mullion and the required insulation. As shown in FIG. 6, the end cap 54 includes two openings 55 corresponding with the hollow portion of the plastic molding 50. This is to allow a right angled fixing member 56 to pass through the end caps 54. This fixing member 56 is then attached to the plastic moldings 50 of the mullion by a screw 57 passing through the projection 31, and to the frame by a screw 58 passing though the projection 31 on the frame molding 30 as shown in FIG. 7.

With a mullion of this type, it is possible to form a cabinet with a frame around the outer periphery, and no sub-division at the point when the cabinet is foam filled. Thereafter, a decision can be made as to whether sub-division is required, for example in response to an order being received. If sub-division of the cabinet is required at this time, the required mullions may be formed and screwed into position. Any number of mullions may be added as required. Then, if the cabinet is to be a freezer cabinet, a heater element may be inserted into molding of the cabinet frame and run along the mullions behind the surfaces where the door or drawers are to seal, before the final cover strip is added. This is of particular commercial advantage as it allows a limited number of different cabinets to be preformed and stocked, and then, in response to demand, these can be customised to a customers particular requirements, both in terms of sub-division and the inclusion of a heater. This compares to prior systems in which it was necessary at the point of forming the cabinet to determine its final configuration, namely to include the required cross-members and heating elements. This meant that with the prior art system, it was necessary either to stock a large number of different models to enable quick response to a customer request, which entails a large cost of cabinets waiting placement of an order and storage costs, or a long delay between an order being received and delivery of the required cabinet. Compared to this, the present invention allows a reduction in the number of stock cabinets, whilst allowing orders to be met quickly.

What is claimed is:

1. A refrigerator cabinet including an inner liner defining an interior of the cabinet and an outer shell, the cabinet including a hollow member having low thermal conductivity connected between the inner liner and the outer shell around an opening of the cabinet, the hollow member including a strip of magnetic material against which a closure of the cabinet abuts, and a removable cover permitting access to the interior of the hollow member, in which the hollow member is a plastic material and the strip of magnetic material is thermally bonded to the hollow member wherein the strip of magnetic material is located on a portion of the hollow member that is separate from the removable cover.

2. A cabinet according to claim 1, in which the hollow member is molded or extruded and the strip of magnetic material is thermally bonded to the hollow member during molding or extrusion.

3. A refrigerator cabinet including an inner liner defining an interior of the cabinet and an outer shell, the cabinet including a hollow member having low thermal conductivity connected between the inner liner and the outer shell around an opening of the cabinet, the hollow member including a strip of magnetic material aigainst which a closure of the cabinet abuts, and a removable cover permitting access to the interior of the hollow member, in which a heater element is provided within the interior of the hollow member and is accessible via the removable cover, the hollow member includes an internal leg that defines a gap between the leg and a side of the hollow member, and the heater member is received and held within the gap.

4. A cabinet according to claim 3, in which the heater element is provided immediately adjacent the side of the hollow member associated with the strip of magnetic material.

5. A cabinet according to claim 3, in which the hollow member is formed of a plastic material.

6. A cabinet according to claim 3, in which the strip of magnetic material is bonded to the hollow member.

7. A cabinet according to claim 3 wherein the strip of magnetic material is located on a portion of the hollow member that is separate from the removable cover.

8. A refrigerator cabinet including an inner liner defining an interior of the cabinet and an outer shell, the cabinet including a hollow member having low thermal conductivity connected between the inner liner and the outer shell around an opening of the cabinet, the hollow member including a strip of magnetic material against which a closure of the cabinet abuts, and a removable cover permitting access to the interior of the hollow member, in which the hollow member includes a flange that abuts against the shell, and in which the flange is attached to the shell by an adhesive strip wherein the strip of magnetic material is located on a portion of the hollow member that is separate from the removable cover.

9. A cabinet according to claim 8, in which the hollow member includes a clip or cleat that allows the liner to be attached to the hollow member by an interference fit.

10. A refrigerator cabinet including an inner liner defining an interior of the cabinet and an outer shell, the cabinet including a hollow member having low thermal conductivity connected between the inner liner and the outer shell around an opening of the cabinet, the hollow member including a strip of magnetic material against which a closure of the cabinet abuts, and a removable cover permitting access to the interior of the hollow member, in which the hollow member is formed as a frame for the opening of the cabinet before being installed in the cabinet as a single piece, wherein the strip of magnetic material is located on a portion of the hollow member that is separate from the removable cover enabling the removable cover to be removed without moving the strip of magnetic material.

11. A cabinet according to claim 10, in which a corner piece is provided to connect parts of the hollow member at the corners of the frame.

12. A cabinet according to claim 11, in which the corner piece comprises a connector having two legs spaced by an angle corresponding generally to the angle between the two parts of the hollow member.

13. A cabinet according to claim 12, in which the angle between the two legs of the connector will about 90°.

14. A cabinet according to claim 12, in which the corner piece is formed as a unitary piece.

15. A cabinet according to claim 11, in which the corner piece is formed from the same material as the hollow member.

16. A cabinet according to claim 15, in which the corner piece and hollow member are formed from a plastics material, and in which the corner piece and hollow member are joined by an ultrasonic weld.

17. A refrigerator cabinet including an inner liner defining an interior of the cabinet and an outer shell, the cabinet including a hollow member having low thermal conductivity connected between the inner liner and the outer shell around an opening of the cabinet, the hollow member including a strip of magnetic material against which a closure of the cabinet abuts, and a removable cover permitting access to the interior of the hollow member, in which at least one cross-member for sub-division of the opening of the refrigeration cabinet is removably attached to the hollow member, the cross-member forming part of a mullion that subdivides a cabinet interior defined by the liner wherein the strip of magnetic material is located on a portion of the hollow member that is separate from the removable cover.

18. A cabinet according to claim 17, in which the cross-member is formed by spaced apart hollow members each of which is attached to the inner liner that extends into the interior of the cabinet, and a face panel provided between the two hollow members.

* * * * *